US005148656A

United States Patent [19]

Meaghan

[11] Patent Number: 5,148,656

[45] Date of Patent: Sep. 22, 1992

[54] TRAINING REINS

[75] Inventor: Robert C. Meaghan, Belford, N.J.

[73] Assignee: Miller Harness Company, Inc., East Rutherford, N.J.

[21] Appl. No.: 619,867

[22] Filed: Nov. 29, 1990

[51] Int. Cl.[5] ..... B68B 1/04

[52] U.S. Cl. ..... 54/36; 54/71

[58] Field of Search ..... 54/36, 71; 40/299, 303, 40/638; 434/225, 255

[56] References Cited

U.S. PATENT DOCUMENTS

| | | | |
|---|---|---|---|
| 75,614 | 3/1868 | Woodmansee . | |
| 108,638 | 10/1870 | Scott . | |
| 148,550 | 3/1874 | Cook . | |
| 253,553 | 2/1882 | Peirce . | |
| 289,072 | 11/1883 | Coy . | |
| 289,406 | 12/1883 | Gottheimer . | |
| 301,274 | 7/1884 | Rand et al. . | |
| 338,581 | 3/1886 | Barlow . | |
| 372,362 | 11/1887 | Dannhauer | 54/71 |
| 664,518 | 12/1900 | Whitman | 54/36 |
| 827,818 | 8/1906 | Pollock | 54/36 |
| 872,347 | 12/1907 | Howell . | |
| 1,012,009 | 12/1911 | Potter . | |
| 1,572,506 | 2/1926 | Renne . | |
| 2,426,716 | 9/1947 | Telford | 54/36 |
| 2,883,044 | 4/1959 | Kendrick | 40/299 X |
| 3,104,507 | 9/1963 | Blankenship | 54/71 |
| 3,161,005 | 12/1964 | Ackerson | 54/71 |
| 3,672,075 | 6/1972 | Eikelenboom | 272/53.2 X |
| 3,751,828 | 8/1973 | Frame . | |
| 3,952,704 | 4/1976 | Webb | 119/29 |
| 4,004,403 | 1/1977 | Henry, II | 54/71 |
| 4,190,968 | 3/1980 | Clapp et al. | 119/29 X |
| 4,416,105 | 11/1983 | Gauthier et al. | 54/71 |
| 4,535,724 | 8/1985 | David | 119/29 |
| 4,584,238 | 4/1986 | Gen et al. | 40/638 X |
| 4,765,276 | 8/1988 | Kime | 119/29 |
| 4,895,257 | 1/1990 | Winslow | 40/638 X |

FOREIGN PATENT DOCUMENTS

| | | |
|---|---|---|
| 2596744 | 10/1987 | France . |
| 36575 | 6/1912 | Sweden . |

*Primary Examiner*—Robert P. Swiatek

*Attorney, Agent, or Firm*—Lerner, David, Littenberg, Krumholz & Mentlik

[57] ABSTRACT

Horse riding reins to facilitate the manipulation of a horse by a rider. The reins can be employed in training a rider or a horse, or simply to facilitate the maneuvering of a horse by a rider. The reins provide readily perceptible and identifiable indicia at corresponding locations from the bit so that a rider is able to properly position his hands on the reins to manipulate the horse in the desired manner. The readily perceptible and identifiable indicia can be utilized by an instructor to immediately and clearly instruct a trainee as to the proper positioning of the trainee's hands to control the horse in the desired fashion, or by the trainer to distinguish various tensions on the reins when getting a particular response from a horse. A rider can thus readily appreciate the proper hand positioning and corresponding feel to control the horse in such desired fashion. A set of labels having identifying indicia thereon is also disclosed for permanent or removeable attachment to a set of reins in accordance with a disclosed method, to thereby provide the features described above.

30 Claims, 4 Drawing Sheets

TRAINING REINS

BACKGROUND OF THE INVENTION

The present invention relates generally to horse riding reins, and more particularly to horse riding reins to facilitate the manipulation and maneuvering of a horse. Specific applications of the present invention may include the training of riders to ride horses, aiding handicapped or other riders to ride a horse, or the training of horses.

Although horses were among the first form of transportation for man, the mechanics of properly riding horses remains somewhat complicated, and is therefore difficult to master. Good horsemanship is not only important for riding in competition, but also for preventing injury to the rider or the horse. Indeed, the form and techniques which are practiced in accordance with good horsemanship provide for the comfort for both the rider and the horse so that the riding experience is more enjoyable. Good horsemanship, however, is not easily attainable. Even the ability to properly control a horse is not always easily attainable, especially in the case of physically and/or mentally handicapped persons.

In an attempt to facilitate the development of good horsemanship, certain training devices have been designed, though the usefulness of such devices is limited. For instance, U.S. Pat. No. 3,672,075 to Eikelenboom discloses a training apparatus for practicing the "mechanical athletic side" of horsemanship. What appears to be disclosed in this patent is a mechanical horse. In addition to offering training in mounting and dismounting horses, as well as the development of muscles for riding horses, the Eikelenboom patent discloses a bit and rein mechanism which permits three different rein actions or positions. One of the features of this bit and rein mechanism is the attachment of the reins to a release pawl such that excessive rearward pressure on the release pawl would cause the pawl to rotate about its pivot point, and thereby release the reins from the hook of the release pawl.

U.S. Pat. No. 3,751,828 to Frame discloses an electromechanical device intended for training a person to manipulate the reins of a full or double bridle. The device has lamps which are lighted when sufficient tension is exerted on the snaffle rein or the curb rein. Right and left sensing elements are also provided to permit the sensing of right and left curb rein tension.

U.S. Pat. No. 4,190,968 to Clapp et al discloses a mechanical device to aid a rider in distinguishing between correct leads and proper diagonals, as well as other aspects of good horsemanship. The device comprises pressure-activated switches supported on either side of the chest-shoulder area of the horse. The pressure-activated switches are electrically connected to indicator means in the form of a small light which can be attached to the saddle in view of the rider. The illumination of the light in response to the movement of the horses muscles and shoulder blades provides the rider with an indication as to whether the front lead of the horse is correct or incorrect when at a canter; which diagonal to post when at a trot; the proper time to cue the horse for lead changes, and the position of the horse's hooves.

While each of the above patents disclose devices which may be useful in developing certain aspects of good horsemanship, the development of desirable techniques is necessarily limited. For example, the Eikelenboom and Frame devices are only useful as training devices before the rider mounts a real horse, and though the Clapp et al device can be utilized while actually riding a horse, it is external to that which is typically required in riding a horse, and thus can distract the rider. Further, the Clapp et al device is more of a monitoring device than a training device since a rider might rely on the same rather than learn from it. Without the Clapp et al device, a rider trained with it may not be able to read or sense the horse's natural movements in order to put into practice the fundamental riding techniques which it is intended to facilitate. Moreover, the Clapp et al device simply teaches a rider how to recognize what needs to be done, rather than how to accomplish the same. For instance, the rider would still have to position his hands properly on the reins in order to guide the horse in an appropriate manner.

As alluded to above, it is also desirable to provide means by which physically and/or mentally handicapped persons can enjoy the sport of horseback riding in a safe and comfortable manner for both the rider and the horse. Of course, advanced riding may not be possible or even desirable with certain handicapped persons; however, the accomplishment of being able to independently ride a horse to any degree will be enjoyable and serve to build confidence and self esteem.

As can be appreciated, handicapped individuals have several disadvantages over other individuals, and therefore will experience many problems in controlling a horse from horseback. Such handicapped individuals might include mentally retarded persons, blind persons, or persons lacking in the manual dexterity required for manipulating a horse. The above-discussed devices do not sufficiently address the problems which might be experienced by handicapped persons to thereby enable such handicapped persons to enjoy the sport of horseback riding.

The above-noted difficulties with respect to riding horses makes it apparent that a device to facilitate the training of horses or riders or simply a rider's ability to control and maneuver a horse is warranted. The present invention thus addresses the above and other difficulties which heretofore were lacking in the horse riding industry. It is noted that the present invention has applications for use with horses and other animals, mechanical or live, whether mounted or driven from a carriage or sulky as in the case of trotters. The device of the present invention can be used as a training device prior to a trainee graduating to conventional equipment, or as a permanent riding device to facilitate the control of a horse.

SUMMARY AND OBJECTS OF THE INVENTION

The present invention specifically relates to a device for controlling and maneuvering a horse, such device comprising a set of reins having two ends which are attachable to a bit on a horse to thereby form a loop having a first side and second side, both the first side and second side having gripping sections at corresponding locations from the ends of the reins, each set of corresponding gripping sections having identifying indicia which is readily recognizable by a rider so that the rider can readily locate a desired gripping section on either side of the loop.

The identifying indicia of the gripping sections can be of any suitable means which can be perceived by a rider as identifying a gripping section or set of corresponding gripping sections. The indicia on different sets of corresponding gripping sections need not be identical, substantially identical, or even of the same nature. Indeed, it is not even necessary that the identifying indicia of the same set of gripping sections be identical or of the same nature. The identifying indicia on given gripping sections need only be readily discernable to a rider as compared to the identifying indicia (or lack thereof) of at least adjacent gripping sections on the same side of the reins. That is, the identifying indicia of a specific gripping section or set of corresponding gripping sections would preferably be readily perceptible to a rider relative to the identifying indicia of adjacent gripping sections or adjacent sets of corresponding gripping sections.

Accordingly, such identifying indicia can be readily perceptible and identifiable by sight and/or touch, or any other means for providing an identification of respective gripping sections vis-a-vis other gripping sections. Thus, the identifying indicia of the gripping sections or sets of gripping sections can be in the form of different colors, markings, shapes, materials, symbols, etc. It is also contemplated that sets of gripping sections can be provided with symbols identifiable by the sighted, as well as symbols identifiable by the blind or other handicapped persons. For instance, the Arabic numerals 1–4 can be provided on differently colored gripping sections together with the Braille numerals 1–4. In accordance with another aspect of the present invention, the identifying indicia can be provided on labels which are permanently or removably (as by, for instance, VELCRO) attached to a set of reins to provide the above and other features.

The present invention also relates to a method for controlling and maneuvering a horse including the steps of providing a set of reins substantially as described above, attaching such reins to the bit on a horse, holding the reins by gripping sections on the first and second sides thereof, changing the positioning of the hands on the gripping sections of the reins in accordance with the identifying indicia means thereon to thereby control the horse as desired. The change in the positioning of the hands can be made in accordance with instructions given verbally from an instructor, or as previously instructed by an instructor, a video tape, an audio tape, written instructions or otherwise, or even as previously determined by the rider himself.

The present invention also relates to a set of labels which are adapted to be attached to a set of reins, whether a conventional set of reins or a set of reins in accordance with the above, whereby the labelled set of reins could be used to facilitate changes in the positioning of a rider's hands. The set of labels would comprise at least one pair of labels and means for attaching one of the pair to a first side of a set of reins and the other of the pair to a second side of the same set of reins. The pair of labels would also include identifying indicia as described above. Again, the identifying indicia need not be substantially identical or even of the same nature within the at least one pair of labels or as against any other pair of labels within the set.

The labels can be applied to the set of reins adhesively or by any suitable fastener. Such fastener can even be of the type which is removeable, such as VELCRO. The labels can be flat for application to one surface of the reins or wrappable around the reins. If wrappable, the removeable fastening means can be provided on the labels only, rather than a portion of the fastener on the reins and a portion on the label. For instance, VELCRO or snap fastening means can be provided on either end of the labels so that when it is wrapped about the reins, the separate portions of the fastening means can cooperate to attach the same to the reins. In the case of wrappable labels, means can be provided to prevent the wrapped label from sliding on the reins. This can take the form of a material which has a high coefficient of friction against the material of the reins, for instance, rubber against rubber or rubber against leather. In the alternative, the wrappable label can be provided between two boss-like portions of the reins, or against at least one such boss-like portion of the reins, to prevent the same from sliding. Such boss-like portions can be those which separate gripping sections on the reins.

The present invention also relates to a method of making a set of reins which is adapted to facilitate changes in the position of a rider's hands. The method includes the steps of providing a set of reins, conventional or in accordance with the above, which is attachable to a bit on a horse, providing at least one pair of labels having identifying indicia which is readily recognizable by a rider, attaching one of at least one pair of labels to a first side of the set of reins and attaching the other of the at least one pair of labels to a second side of the reins, thereby providing a converted set of reins which can aid a rider in properly positioning his hands on the reins, and/or changing the positioning of his hands on the reins. It is noted that this method is applicable not only to a conventional set of reins, but also to a set of reins in accordance with the above which, for instance, only provides identifying indicia which is visually perceptive. The use of a label, perhaps a wrappable label of the type contemplated herein, could render the set of reins to be readily recognizable by touch so that a blind person could use the reins.

It is thus an object of the present invention to provide a set of reins for training beginning or novice riders to ride already trained horses.

It is another object of the present invention to provide a set of reins for riders who are training horses.

It is another object of the present invention to provide a set of reins which can be used by physically and/or mentally handicapped persons in riding horses.

It is another object of the present invention to provide a set of horse riding reins which will enable an instructor to better instruct beginning or novice riders to ride already trained horses by providing on the reins readily identifiable indicia so that the instructor is able to clearly instruct a trainee as to the proper positioning of the trainee's hands on the reins.

It is another object of the present invention to provide a set of reins having readily identifiable indicia on either side of the reins at corresponding locations from the bit.

It is another object of the present invention to provide a set of reins having readily identifiable indicia of any type, including indicia which is readily identifiable by sight, sound or touch.

It is another object of the present invention to provide a method of instructing beginning or novice riders to ride already trained horses by providing a set of reins with readily identifiable indicia thereon, and instructing a trainee to change hand positions according to the readily identifiable indicia on the set of reins.

It is another object of the present invention to provide a method of training a horse or simply riding a horse by providing a set of reins with readily identifiable indicia thereon, and changing the positioning of the hands according to such readily identifiable indicia.

It is another object of the present invention to provide a set of labels which carry identifying indicia so that a set of reins, conventional or in accordance with other aspects of the present invention, can be modified for use by particular persons, or for specific applications of, perhaps, instruction or practice.

It is another object of the present invention to provide a method of modifying a set of reins by labelling the same with labels having identifying indicia, to thereby provide the above discussed advantages.

The objects of the present invention can be fulfilled by a set of reins attachable to a bit on a horse to form a loop having a right side and a left side, the right and left sides having at least a first set and a second set of identifying indicia sequentially disposed to identify different areas of said reins, each set of identifying indicia being discernable from other sets of identifying indicia, and said identifying indicia being readily recognizable by a rider so that the rider can discern one set of identifying indicia from another set of identifying indicia, to thereby facilitate changes in the positioning of the rider's hands on said reins in accordance with said identifying indicia.

The objects of the present invention can also be fulfilled by a set of reins attachable to a bit on a horse to form a loop having a first side and a second side, both of which sides have at least one gripping section adapted to be held by a rider, each gripping section having identifying indicia which is readily recognizable by a rider so that such rider can readily locate a desired gripping section.

The objects of the present invention can also be fulfilled by a method of controlling and maneuvering a horse, including the steps of providing a set of reins having two ends constructed for attachment to a bit and having a first side and a second side, both of which sides have at least two gripping sections at corresponding locations from the ends of the reins, each set of corresponding gripping sections having different identifying indicia which are readily recognizable by a rider, attaching the reins to a bit on a horse, holding the reins by gripping sections on the first and second sides thereof, and changing the positioning of the hands on the gripping sections according to the identifying indicia thereon in order to control the horse in the desired fashion.

The objects of the present invention can also be fulfilled by providing a set of labels adapted to be attached to a set of reins, the set of labels comprising at least one pair of labels and means for attaching the same to either side of the reins, the at least one pair of labels having identifying indicia which is readily recognizable by a rider using the labelled reins so that the rider can discern the at least one pair of labels from other portions of the reins or other labels attached to the reins.

The objects of the present invention can also be fulfilled by a method of making a set of reins which can facilitate changes in or simply the proper positioning of a rider's hands while riding, the method including the steps of providing a set of reins which is attachable to a bit on a horse, providing at least one pair of labels having identifying indicia which is readily recognizable by a rider, and attaching the at least one pair of labels to either side of the set of reins.

BRIEF DESCRIPTION OF THE DRAWINGS

The foregoing and other objects of the present invention will become apparent, as will a better understanding of the concepts underlying the present invention, by reference to the description which follows and refers to the accompanying drawings in which.

DETAILED DESCRIPTION OF THE INVENTION

Figure 1:
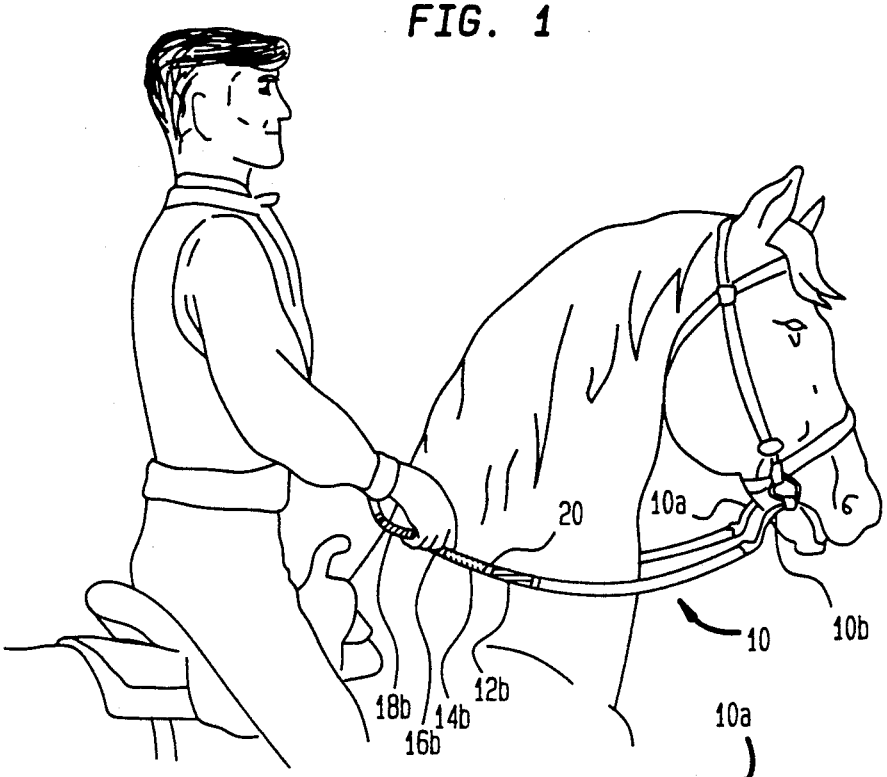
FIG. 1 is a side view of a rider on horseback and using a set of reins in accordance with the present invention.
Figure 2:
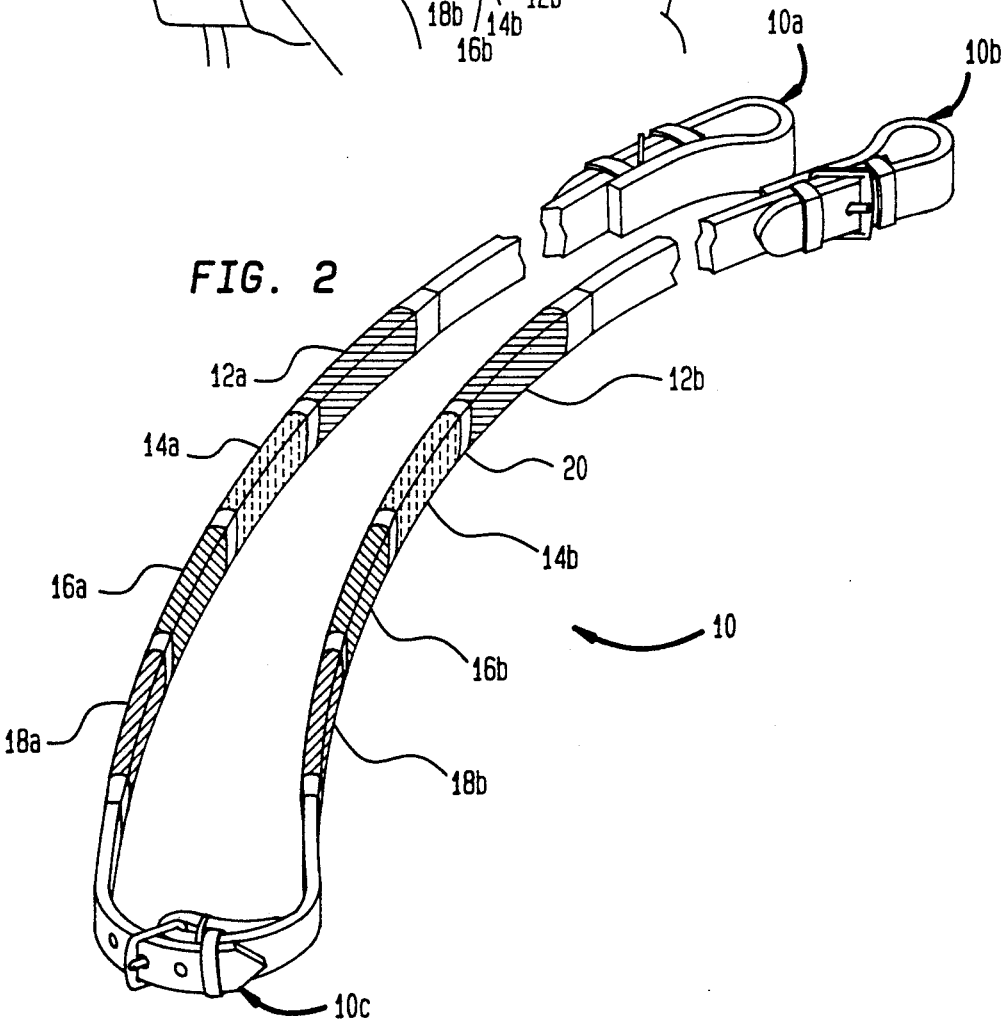
FIG. 2 is a perspective view of a set of reins in accordance with the present invention.
Figure 3:
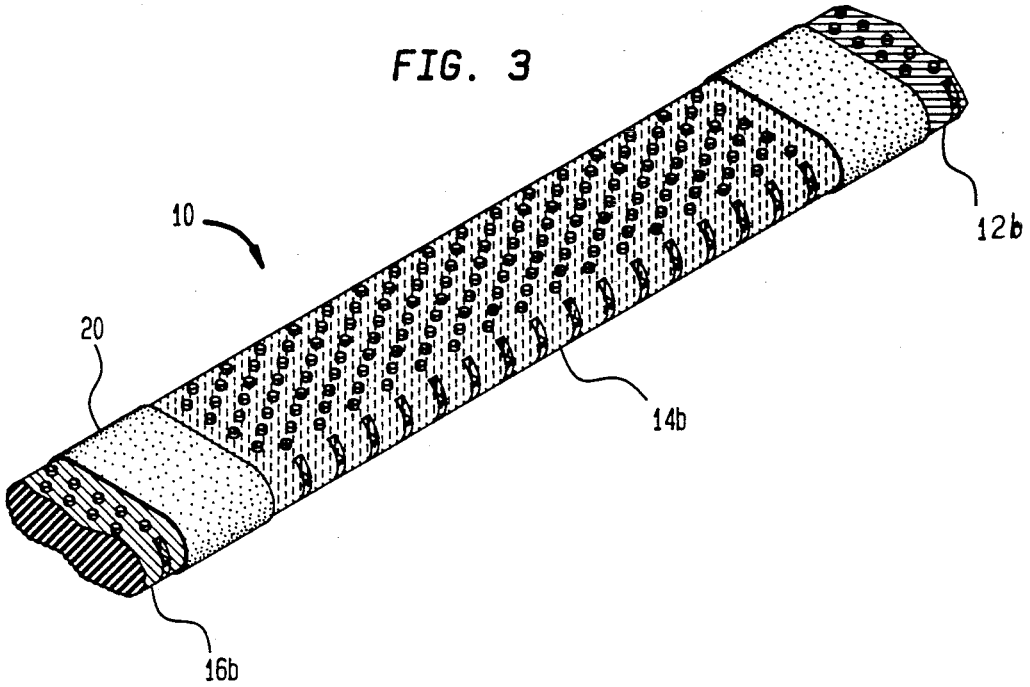
FIG. 3 is an enlarged perspective view of a gripping section of the reins shown in FIG. 2.

Referring to the figures, FIGS. 1–3 show a preferred embodiment of a set of reins generally designated as 10 in accordance with the present invention. The reins 10 are made from a length of strap-like leather, except as described below, and include a first end 10*a* and a second end 10*b* connected by an intermediate portion which is adjustable in length by a belt buckle and hole arrangement at 10*c*. The ends 10*a* and 10*b* also include belt buckle and hole arrangements so that the ends can be adapted for attachment to the bit on a horse, as shown in FIG. 1. Of course, conventional hook studs can also be used at the ends 10*a* and 10*b*.

On either side of the reins 10 are sets of gripping sections 12, 14, 16 and 18. More specifically, the gripping sections on the first side of the reins 10 are identified as 12*a*, 14*a*, 16*a* and 18*a*, and their corresponding gripping sections on the second side of the reins 10 are identified as 12*b*, 14*b*, 16*b* and 18*b*. In the preferred embodiment, these gripping sections are made of textured rubber in order to improve the rider's grip on the reins 10. The textured rubber is secured to the elongate strap-like leather by stitched or otherwise secured leather pieces 20 which also serve to separate and/or define the gripping sections 12, 14, 16 and 18. The gripping sections on both sides of the reins 10 are provided at corresponding locations from the ends 10*a* and 10*b*, or the point of attachment to the bit on a horse. Of course, the number of gripping sections can be increased or decreased, while still fulfilling the purposes and objects of the present invention.

In the preferred embodiment, each set of corresponding gripping sections 12, 14, 16 and 18 includes identifying indicia of some type which is readily perceptible and identifiable by a rider on a horse using the reins 10. As discussed above, the identifying indicia need only be readily discernable from the identifying indicia (if provided at all) on adjacent gripping sections so that the rider can readily identify the gripping sections to thereby facilitate changes in the positioning of his hands.

The identifying indicia of the gripping sections can be of any nature. In the preferred embodiment such indicia is perceptible by sight, different colors being provided for different sets of corresponding gripping sections. Thus, the first set of corresponding gripping sections 12 are shaded for the color blue; the second set of corresponding gripping sections 14 are shaded for the color purple; the third set of corresponding gripping sections 16 are shaded for the color green; and the fourth set of corresponding gripping sections 18 are shaded for the color brown. In this manner, a rider utilizing the reins can easily change the positioning of his hands in accordance with instructions received from an instructor either previously or simultaneously; or in accordance with hand positioning previously determined by himself. All that the rider need do is locate the color of the desired gripping section, as instructed or previously determined, and move his hands accordingly. Of course, it is possible that in order to control or guide the horse in specific ways, for instance to make a turn, the rider must hold the reins by different sets of gripping sections at the same time. The present invention facilitates the placement of the hands since the instructions could call for one color on the left side and another color on another side. In any event, the rider can change the positioning of his hands quickly and properly by utilizing the present invention.

Figure 4:
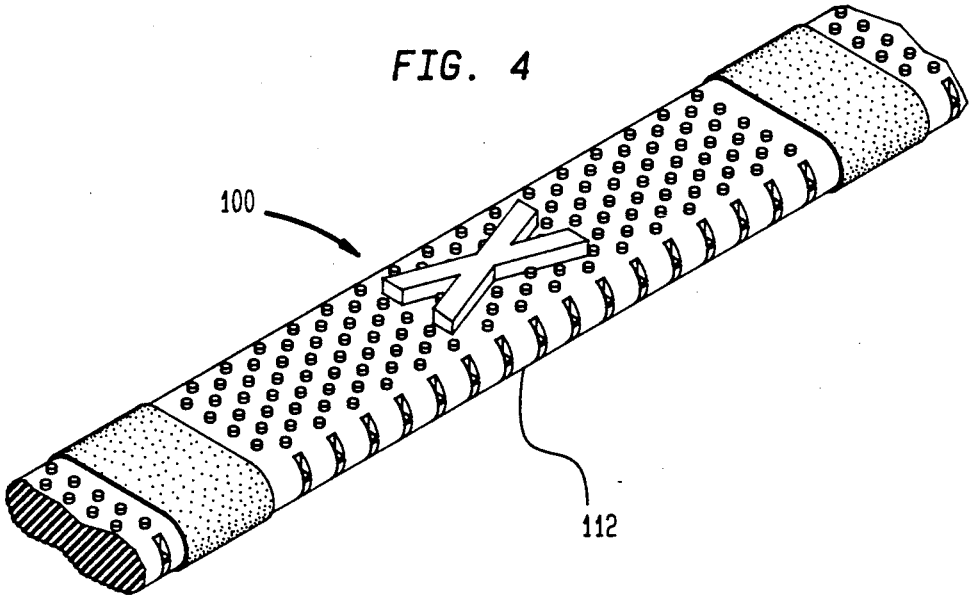
FIG. 4 is an enlarged perspective view of a gripping section of a set of reins in accordance with another embodiment of the present invention, illustrating in particular raised indicia identifiable by touch.

Referring to FIG. 4, a gripping section of a set of reins generally designated as 100 in accordance with another embodiment of the present invention is illustrated. This aspect of the present invention contemplates identifying indicia which are readily perceptible and identifiable by touch. Accordingly, a raised letter "X" is shown on the gripping section 112. Of course, adjacent gripping sections should have different indicia so that the different gripping sections or sets thereof can be distinguished. Moreover, as suggested above, the identifying indicia readily identifiable by touch can be in any appropriate form. For instance, the different sets of gripping sections can be made in different shapes; the different sets of gripping sections can have coverings of different materials, one being rough, another being smooth; or the different sets of gripping sections can include other symbols identifiable by the blind, such as braille. As noted above, it is only necessary that the rider be able to readily discern one gripping section from another.

Figure 5:
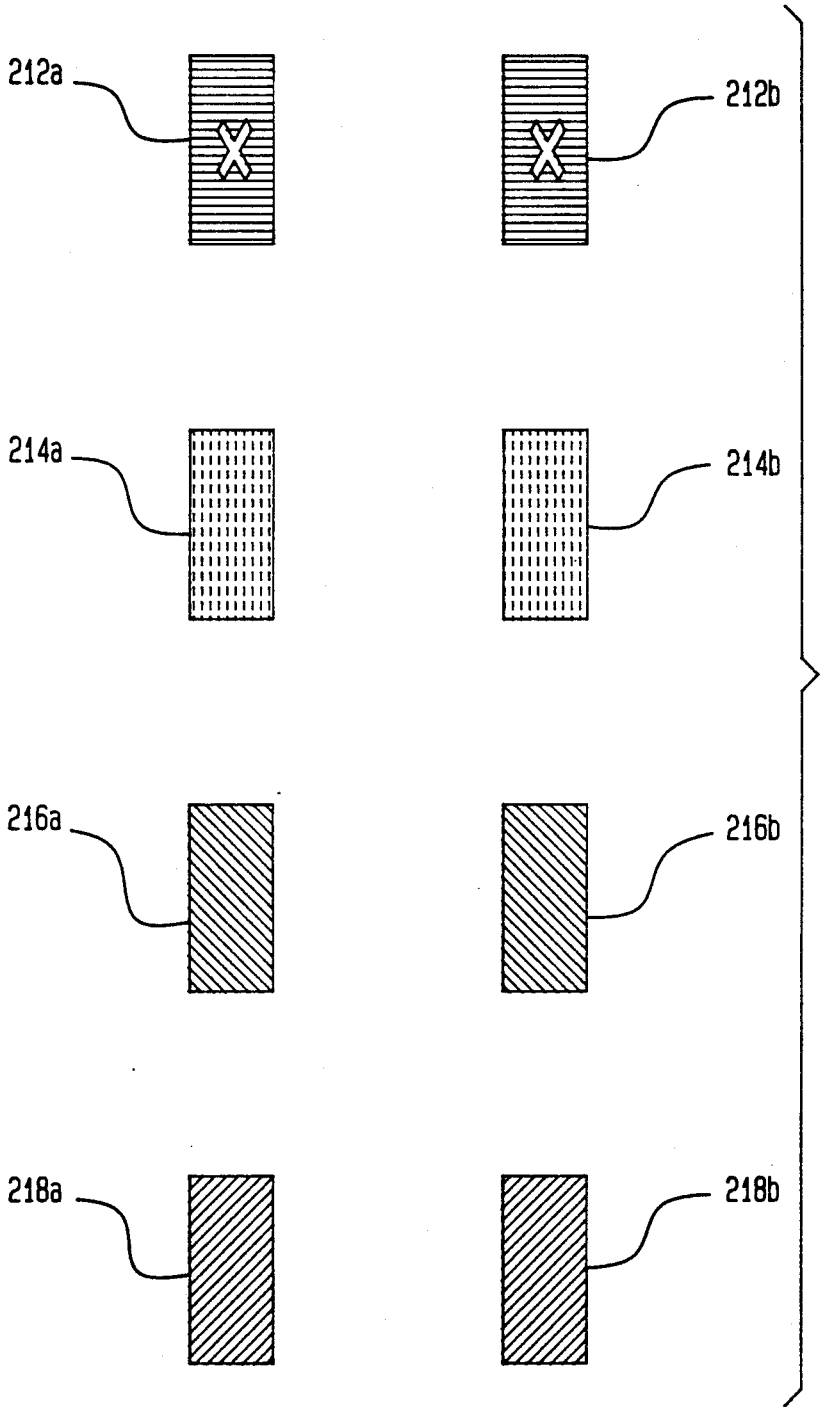
FIG. 5 is a plan view of a set of labels for modifying a set of reins in accordance with another embodiment of the present invention.
Figure 6:
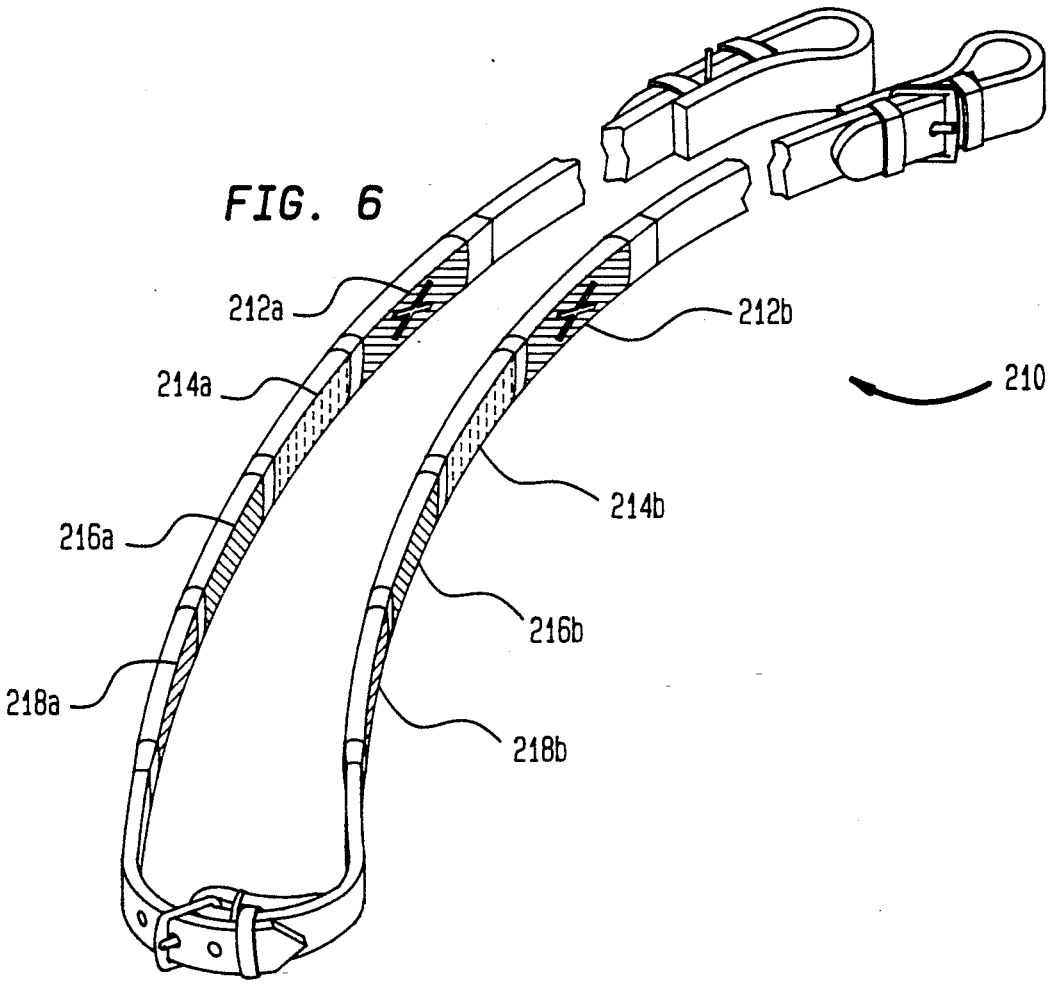
FIG. 6 is a perspective view of a set of reins having the labels shown in FIG. 5 attached thereto.

In accordance with another aspect of the present invention, permanent (adhesive) or removable (snaps or VELCRO) stickers or labels can be provided in sets for use in modifying a conventional set or reins or set or reins in accordance with the present invention. A set of labels of this type are shown in FIG. 5, there being four sets of labels 212, 214, 216 and 218. As with the gripping sections in the first embodiment, these labels include identifying indicia. The first set of labels 212 are shaded for the color blue; the second set of labels 214 are shaded for the color purple; the third set of labels 216 are shaded for the color green; and the fourth set of labels 218 are shaded for the color brown. The set of labels 212 also include raised identifying indicia in the form of the letter "X", as previously described in connection with FIG. 4. FIG. 6 shows reins generally designated as 210 in accordance with this embodiment of the present invention. The reins 210 include the labels 212–218 applied thereto at corresponding locations on either side thereof. Once the labels have been applied to the reins 210, the reins can be used in the same manner as described above with respect to the previous embodiments.

It is noted that the labels in accordance with this aspect of the present invention can be of any nature as long as they provide some identifying indicia by which a rider can identify a desired portion of the reins. Thus, in addition to labels which can be attached to one surface of the set of reins, it is desirable to provide a set of labels which can wrap around to other surfaces or cover the entire surface of the reins in the area of the label. As to removeable labels which are wrappable about the reins, the fastener thereof can be provided on the labels only. For instance, rather than providing one portion of a hook and loop fastener (such as VELCRO) on the reins and the other cooperating portion of the hook and loop fastener on the label, both portions of the hook and loop fastener can be provided on either end of the labels themselves so that when the labels are wrapped around the reins, these portions can cooperate to removably fasten the label to the reins. Of course, other types of removeable fasteners, such as snap fasteners, are contemplated.

To prevent the wrappable labels from sliding on the reins, the inner surface of the labels can be of a material which will frictionally engage the material of which the reins are made. For instance, a rubber inner surface will frictionally engage reins made of leather, rubber or most other materials. Thus, the labels may even be in the form of a flexible piece of rubber having VELCRO fasteners at either end so that when it is wrapped tightly about the reins, the VELCRO fasteners can cooperate to attach the same to the reins, and the rubber surface can prevent the label from sliding on the reins. In the alternative, or in addition to providing such frictionally engageable material, the labels can be provided between boss-like portions of the reins, such as the secured leather pieces 20 shown in FIGS. 2–4. The secured leather pieces 20 would help prevent the label from sliding. For that matter, the labels themselves could be arranged in abutment to one another between such leather pieces which are, in conventional reins, provided only at the top and bottom of each side of the reins.

Thus, a conventional set of reins can be modified to provide a set of reins in accordance with the present invention. Even a set of reins in accordance with previous embodiments of the present invention can be modified to provide additional advantages. For instance, a label having indicia identifiable by touch can be applied to a colored gripping section if a blind or otherwise handicapped person is scheduled to use the reins. Again, the labels 212–218 can be removable to thereby provide the advantage of interchangeability.

Indeed, the present invention contemplates a method of making a set of reins or modifying a set of reins to facilitate the change in the positioning of the riders hands. Such method includes the step of attaching of a set of labels to a set of reins, where the labels have identifying indicia of the type discussed above.

Of course, as with the previous embodiments of the present invention, any means for providing identifying indicia on a conventional set of reins is contemplated in accordance with this aspect of the present invention. Thus, the labels may include indicia of any nature, or means other than labels can be employed in order to distinguish different areas or sections of the reins so that a rider can readily change the positioning of his hands in accordance with previously provided or simultaneous instructions, or in accordance with that which was previously determined by the rider himself.

Accordingly, with the present invention, a rider is able to learn different locations on the reins, as defined by the gripping sections, for controlling or guiding the horse in a particular fashion. In most instances, the rider will retain his acquired knowledge of such locations so that he can graduate and properly use a conventional set of reins. It is recognized that different riders may hold a set of reins at different locations in order to guide the horse in a similar fashion or practice the same technique. It is also recognized that a particular rider may have to change the positioning of his hands on a set of reins depending upon which horse he mounts. The size of the rider and the size of the horse will determine where the rider must hold a set of reins in order to control the horse in a specific manner or practice a particular technique. For instance, an instructor may instruct one rider to "shorten up" on the reins to the purple gripping sections in order to practice a certain technique, while instructing another rider to shorten up to the green gripping sections to practice the same technique. The present invention accommodates these differences since the rider utilizing the reins in accordance with the present invention can identify the appropriate "feel" of the reins required to control the horse in a specific manner or practice a particular technique. As established riders are aware, there are identifiable tensions for manipulating a horse in a particular manner. It is these tensions and the corresponding feel which a rider can become familiar with if trained with the reins in accordance with the present invention.

As noted, a method of instructing a rider to ride a horse or simply a method of controlling a horse is also contemplated in accordance with the present invention. Such a method would include the steps of providing a set of reins having at least first and second identifying indicia on either side of the reins and at corresponding locations from the two ends of the reins; attaching the reins to a bit on a horse; holding the reins; and changing the positioning of the hands on the reins in accordance with the identifying indicia in order to control the horse in a desired fashion.

While the foregoing description and figures are directed to the preferred embodiments of the horse riding reins in accordance with the present invention, it should be appreciated that certain modifications can be made, and are indeed encouraged to be made, in the materials, structure and arrangement of the disclosed embodiments without departing from the spirit and scope of the present invention which is intended to be captured by the claims set forth below.

What is claimed is:

1. A set of reins attachable to a bit on a horse to thereby form a loop having a first side and a second side, each of which sides having at least two gripping sections to be held by a rider, each gripping section having identifying indicia to enable a rider to locate a desired gripping section while riding the horse, said identifying indicia being readily recognizable by a rider so that the rider can discern gripping sections from one another or other sections of said reins.

2. The reins in claim 1, wherein said gripping sections on said first and second sides are at corresponding locations from the point of attachment of said reins to the bit.

3. The reins in claim 2, wherein the identifying indicia on corresponding gripping sections are substantially the same.

4. The reins in claim 3, wherein the identifying indicia of at least one set of gripping sections are identifiable by sight.

5. The reins in claim 4, wherein the identifying indicia of a first set of corresponding gripping sections comprise a first color, and the identifying indicia of a second set of corresponding gripping sections comprise a second color.

6. The reins in claim 3, wherein the identifying indicia of at least one set of said gripping sections are identifiable by touch.

7. The reins in claim 6, wherein the identifying indicia of said at least one set of gripping sections are also identifiable by sight.

8. The reins in claim 6, wherein the identifying indicia of at least one set of gripping sections are in the form of raised symbols on said gripping sections.

9. The reins in claim 6, wherein the identifying indicia of at least one set of gripping sections are in the form of different materials for each corresponding set of gripping sections.

10. The reins in claim 3, including labels attached to said reins, said labels carrying said identifying indicia.

11. The reins in claim 10, wherein at least a portion of said labels are removably attached to said reins.

12. The reins in claim 1, wherein said reins have four sets of corresponding gripping sections on each side of the loop, each set of corresponding gripping sections having different identifying indicia than each other set of corresponding gripping sections.

13. The reins in claim 12, wherein the identifying indicia of at least one set of identifying indicia are visually perceptive.

14. The reins in claim 13, wherein the identifying indicia of at least one set of identifying indicia are a color.

15. The reins in claim 14, wherein each said gripping section includes grip-improving means for improving a rider's grip on said reins.

16. The reins in claim 15, wherein said grip-improving means is a textured rubber.

17. The reins in claim 12, wherein the identifying indicia of at least one set of identifying indicia are identifiable by touch.

18. A method of controlling and maneuvering a horse, said method comprising the steps of:

a. providing a set of reins having two ends being constructed for attachment to a bit, said reins having a first side and a second side, each of which sides having at least two gripping sections at corresponding locations from said ends, each set of corresponding gripping sections having different identifying indicia which are readily recognizable by a rider;

b. attaching said reins to a bit on a horse;

c. holding the reins by gripping sections on the first and second sides thereof; and d. changing the positioning of the hands on the gripping sections according to the identifying indicia thereon in order to control the horse in the desired fashion.

19. The method in claim 18, including the step of instructing the rider to change hand positioning on the gripping sections by identifying the respective identifying indicia on respective gripping sections on the first and second sides of the reins.

20. The method in claim 19, wherein the step of instructing the rider is performed verbally while the rider is riding the horse.

21. A set of reins attachable to a bit on a horse to thereby form a loop having a right side and a left side, said right and left sides each having at least first and second identifying indicia, said first and second identifying indicia on the right and left sides together defining a first set and a second set of identifying indicia on the reins, said first and second sets being sequentially disposed to identify different areas of said reins, the identifying indicia of each respective set being substantially identical to one another, yet each set of identifying indicia being discernable from other sets of identifying indicia, and said identifying indicia being readily recognizable by a rider so that the rider can discern one set of identifying indicia from another set of identifying indicia, to thereby facilitate the proper positioning of the rider's hands on said reins in accordance with said identifying indicia.

22. The reins in claim 21, wherein each set of identifying indicia is at corresponding locations from the point of attachment of the reins to the bit on the horse.

23. The reins in claim 21, including labels attached to the reins, said labels carrying said identifying indicia.

24. The reins in claim 23, wherein at least one set of identifying indicia is identifiable by sight.

25. The reins in claim 23, wherein at least one set of identifying indicia is identifiable by touch.

26. The reins in claim 23, wherein at least one set of identifying indicia is identifiable by both touch and sight.

27. The reins in claim 23, wherein said labels are removably attached to the reins.

28. The reins in claim 21, wherein at least one set of identifying indicia is identifiable by sight.

29. The reins in claim 21, wherein at least one set of identifying indicia is identifiable by touch.

30. A method of making a set of reins which can facilitate changes in the positioning of a rider's hands while riding, said method comprising the steps of providing a set of reins which is attachable to a bit on a horse, providing at least one pair of labels having identifying indicia which are readily recognizable by a rider, attaching one of the at least one pair of labels to a first side of the set of reins and attaching the other of the at least one pair of labels to a second side of the set of reins.

* * * * *